US006883291B2

(12) United States Patent
Grossmann et al.

(10) Patent No.: US 6,883,291 B2
(45) Date of Patent: Apr. 26, 2005

(54) APPARATUS FOR WRAPPING PACKS OF SMOKERS' PRODUCTS

(75) Inventors: Jürgen Grossmann, Wentorf (DE); Jirko Heide, Schwarzenbek (DE)

(73) Assignee: Topack Verpackungstechnik GmbH, Schwarzenbek (DE)

( * ) Notice: Subject to any disclaimer, the term of this patent is extended or adjusted under 35 U.S.C. 154(b) by 0 days.

(21) Appl. No.: 09/983,813

(22) Filed: Oct. 26, 2001

(65) Prior Publication Data

US 2002/0050129 A1 May 2, 2002

(30) Foreign Application Priority Data

Oct. 28, 2000 (DE) ..... 100 53 666

(51) Int. Cl.[7] ..... B65B 11/58; B65B 19/22
(52) U.S. Cl. ..... 53/173; 53/228; 53/234
(58) Field of Search ..... 53/170, 173, 228–234, 53/466, 387.2

(56) References Cited

U.S. PATENT DOCUMENTS

| | | | | | |
|---|---|---|---|---|---|
| 3,810,314 | A | * | 5/1974 | Anderson | 53/372.5 |
| 4,430,842 | A | * | 2/1984 | Focke | 53/220 |
| 4,711,065 | A | * | 12/1987 | Focke et al. | 53/170 |
| 4,999,967 | A | | 3/1991 | Hoffman | |
| 5,168,690 | A | * | 12/1992 | Quadrana | 53/575 |
| 5,177,933 | A | * | 1/1993 | Boriani et al. | 53/234 |
| 5,269,117 | A | * | 12/1993 | Boriani et al. | 53/234 |
| 5,392,586 | A | * | 2/1995 | Imai | 53/234 |
| 5,442,894 | A | * | 8/1995 | Ogata et al. | 53/234 |
| 5,457,932 | A | * | 10/1995 | Spada et al. | 53/234 |
| 5,930,976 | A | * | 8/1999 | Boldrini et al. | 53/234 |
| 6,023,911 | A | | 2/2000 | Elvers et al. | |
| 6,189,296 | B1 | * | 2/2001 | Spatafora et al. | 53/461 |
| 6,557,324 | B1 | * | 5/2003 | Campagnoli et al. | 53/466 |

FOREIGN PATENT DOCUMENTS

| | | |
|---|---|---|
| DE | 37 31 063 | 3/1988 |
| DE | 38 00 432 | 7/1989 |
| DE | 41 22 692 | 2/1992 |
| DE | 42 24 566 | 2/1993 |
| DE | 43 38 945 | 5/1994 |
| DE | 196 50 182 | 6/1998 |
| EP | 0519402 A1 | 12/1992 |
| EP | 0529404 A1 | 3/1993 |
| EP | 0553636 A1 | 8/1993 |

* cited by examiner

*Primary Examiner*—Stephen F. Gerrity
(74) *Attorney, Agent, or Firm*—Venable LLP; Catherine M. Voorhees

(57) ABSTRACT

Successive cigarette packs wherein an inner envelope surrounds an array of smokers' products are advanced against successive foremost blanks of a series of blanks to be converted into outer envelopes of the respective packs. Those portions of the inner envelopes which are secured to each other by an adhesive are mechanically held against separaton prior to complete setting of the adhesive on their way toward the blanks, during entrainment and initial deformation of the blanks and, if necessary, during conversion of the blanks into outer envelopes which surround the respective inner envelopes. The blanks can consist of a light transmitting material.

12 Claims, 5 Drawing Sheets

APPARATUS FOR WRAPPING PACKS OF SMOKERS' PRODUCTS

CROSS-REFERENCE TO RELATED CASES

This application claims the priority of pending German patent application Serial No. 100 53 666.2 filed Oct. 28, 2000. The disclosure of the above-referenced German patent application, as well as that of each US and foreign patent and patent application identified in the specification of the present application is incorporated herein by reference.

BACKGROUND OF THE INVENTION

The present invention relates to improvements in methods of and in apparatus for manipulating parallelepiped packs of cigarettes or other smokers' products, and more particularly to improvements in methods of and in apparatus for confining successive finished packs in converted blanks of wrapping material such as cellophane foil and the like. Still more particularly, the invention relates to improvements in methods of and in apparatus for manipulating finished packs of cigarettes and the like in a packing machine, e.g., in a machine known as film wrapper C 90 which is distributed by the assignee of the present application and serves to confine individual soft packs or hinged lid packs in light-transmitting outer envelopes made of cellophane or the like.

As a rule, a cigarette pack includes at least one inner envelope or wrapper which is made of paper, light-weight cardboard or metallic foil and directly surrounds an array of, for example, twenty cigarettes, and an outer envelope which is normally a converted blank of cellophane foil and surrounds the inner envelope. Such outer envelope can be provided with a customary tear strip to facilitate access to the inner envelope and its contents. The inner envelope includes flaps, tucks, panels and like configurations which are folded over each other and are bonded to one another by layers or films of a suitable adhesive. Reference may be had, for example, to commonly owned U.S. Pat. No. 4,999,967 granted Mar. 19, 1991 to Hoffmann for "APPARATUS FOR DRAPING PACKETS INTO BLANKS OF WRAPPING MATERIAL".

A drawback of presently known methods of and apparatus for confining cigarete packs or the like in wrappers of cellulose foil or the like is that the preparation of packs for draping into blanks necessitates the provision of long paths for the transport of successive finished packs from the machine which turns out such packs to the apparatus which converts blanks into outer envelopes surrounding the packs. The primary reason for the utilization of an elongated path for the transport of packs from the packing machine to the machine or apparatus which provides such packs with outer envelopes is that the adhesive which is to bond overlapping portions of inner envelopes of the packs to each other must set completely prior to the application of outer envelopes; otherwise, the inner envelope is likely to open (e.g., an overlapping flap is likely to become separated from the adjacent (overlapped) flap, tuck or panel upon completion of the outer envelope). The overlapping flaps are likely to become separated from the adjacent portions of the inner envelope at the sides and/or at the bottom of a finished pack which includes an array of cigarettes or the like (e.g., in the so-called quincunx formation) and at least one inner envelope.

Attempts to overcome the afore discussed problems also include the utilization of rapidly or more rapidly setting adhesive substances, e.g., of hot melts in lieu of and/or in addition to the more reliable (stronger) cold setting adhesive which requires a longer period of time to set and to thus reliably bond flaps, tucks, panels and/or otherwise configurated portions of inner envelopes to each other. Furthermore, the provision of sources of several different adhesives and of means for applying such plural adhesives to selected portions of the inner envelopes contributes to the bulk, initial cost and maintenance cost of machines which are designed to provide arrays of cigarettes or the like with one or more inner envelopes.

OBJECTS OF THE INVENTION

An object of the invention is to provide a novel and improved method of confining cigarette packs and analogous parallelepiped commodities in envelopes in a space saving and economical manner.

Another object of the invention is to provide a method which renders it possible to complete the confinement of successive cigarette packs in outer envelopes in a time-saving manner.

A further object of the invention is to provide a method of rapidy confining short or long series of cigarette packs and similar commodities in outer envelopes by utilizing a single type of adhesive for the overlapping parts of the inner envelopes of such commodities.

An additional object of the invention is to provide a method of making cigarette packs of the type having inner and outer envelopes by resorting to simple, compact and relatively inexpensive apparatus.

Still another object of the present invention is to provide a novel and improved apparatus for confining cigarette packs and the like in outer envelopes which can be combined with or incorporated in existing cigarette packing machines.

A further object of the instant invention is to provide the apparatus with novel and improved means for preventing deformation of the inner envelopes of cigarette packs during confinement of such commodities in outer envelopes, e.g., in light-transmitting cellophane foils or the like.

Another object of the invention is to provide the above outlined apparatus with a novel and improved system for the advancement of blanks which are to be converted into outer envelopes of cigarette packs or the like and for the transport of packs which are provided with inner envelopes and are about to be confined in outer envelopes.

An additional object of the invention is to provide the above outlined apparatus with novel and improved means for preventing deformation of inner envelopes of cigarette packs preparatory to and during confinement of such packs in outer envelopes.

Still another object of this invention is to provide the above outlined apparatus with novel and improved means for providing cigarette packs or the like with outer envelopes at the rate at which the packs issue from a modern high-speed packing machine.

SUMMARY OF THE INVENTION

One feature of the present invention resides in the provision of a method of draping blanks of wrapping material (such as blanks of cellophane or other light transmitting material) around successive finished packs containing smokers' products and having portions abutting each other and bearing layers or films of adhesive (e.g., a cold setting adhesive) serving to bond the aforementioned portions to each other upon setting of such adhesive. The method comprises the steps of advancing a series of successive blanks along a first path (e.g., downwardly along a substantially vertical path), conveying successive finished packs in a predetermined direction along a second path (e.g., along an at least substantially horizontal path) which crosses the first path at a station where successive packs engage and entrain successive foremost blanks of the series of blanks in the first path prior to complete setting of each adhesive layer on the pack which approaches or reaches the aforementioned station, and mechanically urging against each other at least those portions of the packs at the station (namely, if necessary ahead of, in and downstream of the station) which contact partially set adhesive layers.

Engagement of successive packs with the blanks at the station entails a partial draping of blanks around the respective packs, and the method can further comprise the step of completing the draping around the respective packs in the second path (i.e., in the path for the packs) downstream of the station (as seen in the predetermined direction). Such method can further comprise the step of mechanically urging against each other, in the course of the completing step at least those portions (e.g., flaps) of the packs which contact partially set or hardened adhesive layers. The completing step can include securing portions of the blanks to each other, and such method can further comprise the step of terminating the urging step upon completion of the respective securing step. Each securing step can include bonding portions of the respective blank to each other.

The aforementioned completing step can include securing portions of the blanks to each other, and such method can further comprise the step of terminating the urging step upon completion of the respective securing step.

Another feature of the present invention resides in the provision of an apparatus for draping blanks of wrapping material around successive finished packs containing smokers' products and having portions which abut each other and bear layers or films of adhesive serving to bond the portions of the packs to each other when the setting or hardening of the adhesive is completed. The improved apparatus can form part of or can cooperate with a cigarette packing machine and includes means for advancing a series of successive blanks along a first path, means for conveying successive finished packs along a second path crossing the first path at a station at which each successive pack engages and entrains the foremost blank of the series of blanks in the first path prior to complete setting of each adhesive layer, and means for mechanically urging against each other at least those portions of the packs at the station which contact partially set adhesive layers.

The means for urging can comprise at least one holder which is adjacent one side of the second path and is located at the station.

The means for urging can comprise means for engaging a plurality of portions of each pack being conveyed along the second path against the respective foremost blank in the first path.

Alternatively, the means for urging can comprise a plurality of holders each of which is arranged to engage a different pack in the second path.

Still further, the means for urging can comprise a plurality of discrete holders which are adjacent the second path and which are disposed downstream of each other (as seen in the predetermined direction). The holders can include a first holder which is arranged to temporarily engage successive packs advancing along a first section of the second path, and a second holder arranged to engage successive packs advancing along a second section of the second path downstream of the first section (as seen in the predetermined direction).

The means for conveying blanks can be arranged to partially drape successive foremost blanks of the series of blanks around the respective oncoming packs as a result of the conveying of packs along the second path across the first path and beyond the aforementioned station (as seen in the predetermined direction). Such apparatus further comprises means far completing the draping of blanks around the respective packs in the second path downstream of the station (again as seen in the predetermined direction).

The means for completing the draping of blanks can include a conveyor which is arranged to receive discrete packs with blanks partially draped around them. The conveyor is disposed at a third section of the second path downstream of the second section, as seen in the predetermined direction. Such conveyor is preferably indexible about a fixed axis and is preferably provided with pockets arranged to receive packs and partially draped blanks from the second section of the second path B. The holders can further include a third holder which is adjacent the conveyor and is arranged to engage portions of packs other than those portions which are or which were engaged by the first and second holders. The conveying means can but need not always be arranged to terminate the conveying of successive packs which are engaged by the third holder. The third holder can include or can cooperate with means for folding portions of partially draped blanks while the respective packs are being advanced by the conveyor. The means for folding can comprise a device which is arranged to fold portions of blanks from below.

The aforementioned means for completing the draping of blanks can comprise or cooperate with means for sealing the blanks. If the holders further include a third holder, such holder can serve to engage successive packs at the second path downstream of the second holder and upstream of the sealing means (as seen in the predetermined direction).

The means for mechanically urging can be arranged to engage portions of packs at least while such packs are being conveyed by the conveying means.

The novel features which are considered as characteristic of the invention are set forth in particular in the appended claims. The improved apparatus itself, however, both as to its construction and the modes of assembling, installing and operating the same, together with numerous additional important and advantageous features and attributes thereof, will be best understood upon perusal of the following detailed description of certain presently preferred specific embodiments with reference to the accompanying drawing.

DESCRIPTION OF PREFERRED EMBODIMENTS

Figure 1:
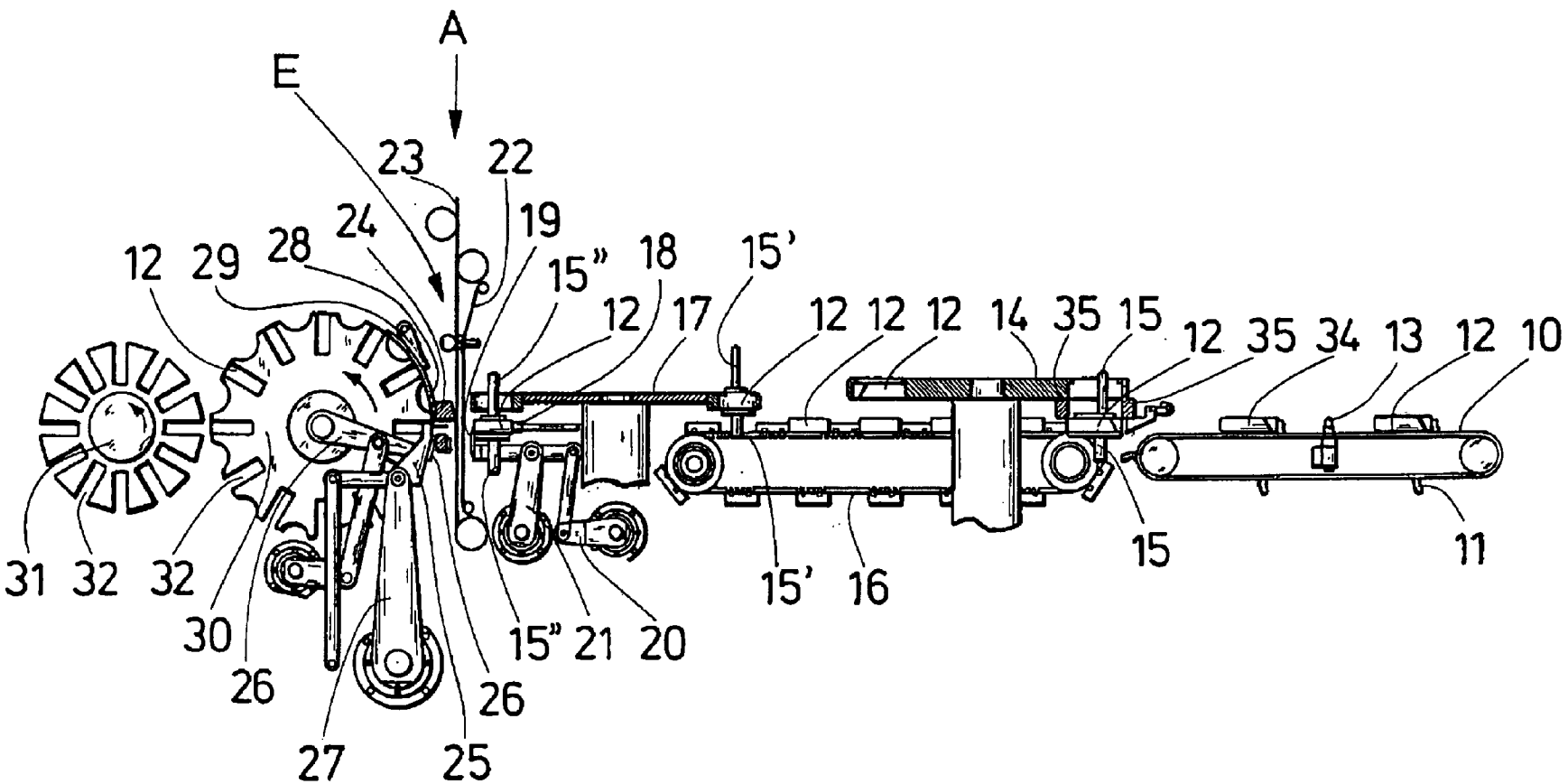
FIG. 1 is a schematic elevational view of an apparatus which forms part of or is combined with a packing machine and embodies one form of the present invention.
Figure 2:
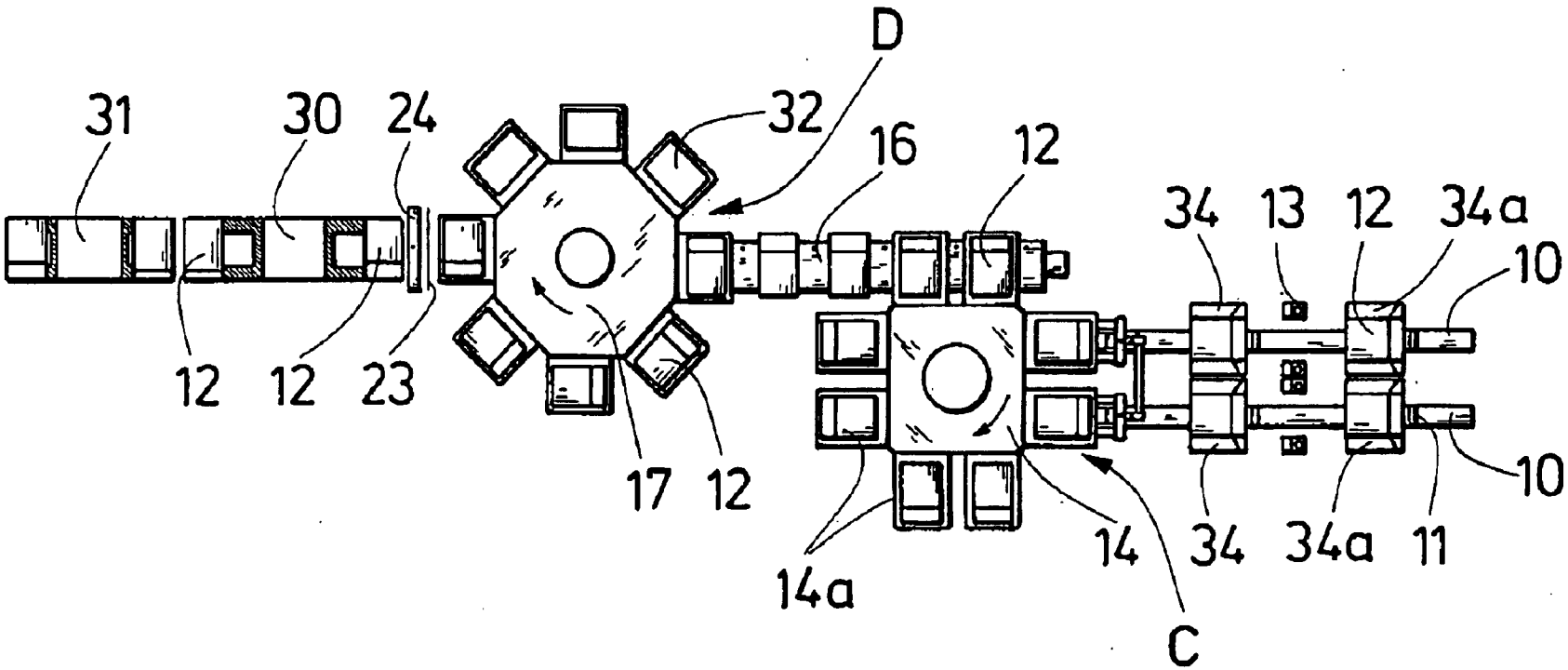
FIG. 2 is a plan view of the structure which is shown in FIG. 1.

FIGS. 1 and 2 show an apparatus which can form part of a cigarette packing machine or is combined with a cigarette packing machine. The improved apparatus serves to provide each of a series of finished block-shaped (parallelepiped) cigarette packs 12 with an outer envelope of cellophane or the like. Each of the packs 12 is assumed to contain an array of parallel cigarettes or other rod-shaped smokers' products and an inner envelope which can be made of paper, cardboard and/or metalllic foil and surrounds the array. Each inner envelope comprises outer lateral flaps 34, inner lateral flaps 34*a*, tucks and panels the overlapping parts of which are held together by layers or films of a suitable adhesive supplied by nozzles 13 one of which is shown in FIG. 1 at a level above an elongated substantially horizontal path wherein the packs 12 advance in the direction indicated by an arrow B.

The means for conveying a series of successive equidistant packs 12 from that part of the packing machine which makes the packs includes a first conveyor here shown as including a pair of spaced-apart parallel endless belts 10 which carry pushers 11 serving to advance successive packs 12 of the respective one of the two series of packs in the direction of arrow B. As can be seen in FIG. 2, the packs 12 on the upper reaches of the belts 10 have outer lateral flaps 34 which must overlap and must adhere to the adjacent inner flaps 34*a* of the respective inner envelopes. The packing machine further comprises customary means (such as the aforementioned nozzles 13) for applying to the inner lateral flaps 34*a* and/or to the outer lateral flaps 34 of the inner envelopes of successive packs 12 one or more layers, strips or films of a suitable adhesive, e.g., a cold setting glue. FIG. 2 shows that the inner lateral flaps 34*a* of the packs 12 on the upper reaches of the respective belts 10 are already folded into planes which are normal to the plane of FIG. 2 but that the outer flaps 34 still extend away from the respective inner flaps. The parts 13 preferably include or constitute nozzles or brushes which supply cold-setting adhesive at a selected rate and to desired portions of the inner and/or outer flaps. In the embodiment which is shown in FIGS. 1 and 2, the pasters 13 apply adhesive films to the inner sides of the outer flaps 34.

The pushers 11 of the belts 10 advance successive packs 12 of the respective series or rows into neighboring pairs of pockets disposed at the periphery of an intermittently indexed turntable 14 arranged to rotate about a vertical axis in such a way that a substantially radially extending pocket 14*a* of the turntable is located in front of each of the endless belts 10. Transfer members or elevators 15 are provided to lift packs 12 from the upper reaches of the belts 10 to the level of the indexible turntable 14. The latter moves the packs 12 stepwise and delivers them into the range of an endless conveyor belt or band 16. This band has receptacles which snugly receive and hold the packs 12 against any changes of shape of their envelopes. This ensures that the parts which are bonded to each other by layers of adhesive cannot become separated during travel with the conveyor 16.

On their way from the level of the upper reaches of the belts 10 to the level of the turntable 14, the outer flaps 34 move past and are folded downwardly by suitably configurated, oriented and dimensioned folding members 35 (one shown in section in FIG. 1) which pivot the outer flaps over the adjacent inner flaps 34*a* to thus complete the shaping of the inner envelopes or wrappers. Such packs are indexed by the turntable 14 in a clockwise direction (as viewed in FIG. 2) through angles of 270° prior to being deposited onto the horizontal upper reach or stretch of the endless band or belt 16 which advances a single row of equidistant packs 12 to a transfer station D. A second elevator 15' is provided to lift successive discrete packs 12 or successive discrete pairs of packs 12 from the level of the upper reach of the conveyor 16 to the level at the three o' clock position of an indexible turntable 17 having radially extending equidistant pockets 32.

The folding members 35 can be omitted if the turntable 14 is provided with suitable folding members (not shown) cooperating with the pockets 14*a* to fold the outer flaps 34 over the respective inner flaps 34*a*.

The turntable 17 indexes the packs. 12 in its pockets 32 to a station where a third elevator 15" lowers the packs 12 to a level in front of an elongated horizontal pusher 18 serving to advance successive packs 12 in the direction of arrow B (see also FIGS. 3 to 7).

The elevator 15' can be provided with means for preventing separation of glued-together parts (such as the flaps 34 and the neighboring flaps 34*a*) of the inner envelopes during transfer from the conveyor 16 onto the turntable 17. The same holds true for the elevator 15" which transfers packs 12 from the turntable 17 to positions in front of the reciprocable pusher 18. For example, at least the elevator 15' can be provided with lateral guides which hold the outer flaps 34 against movement away from the respective inner flaps 34*a*.

The turntable 17 can advance successive packs 12 past a station where the inner envelopes receive revenue labels and/or past a station where the inner envelopes are provided with advertising matter and/or past one or more further stations.

The packs 12 which arrive in front of the pusher 18 are oriented in such a way that the pusher engages a folded over outer flap 34 during its forward stroke. Thus, the pusher 18 also contributes to prevention of deformation of inner envelopes in the event that the adhesive which was supplied at 13 is still not hardened or set to the extent which is necessary to ensure reliable retention of all adhesive bearing parts of an inner envelope, i.e., to prevent the flaps 34 from leaving their desired optimum positions. That outer flap 34 of an inner envelope in front of the pusher 18 which is remote from the pusher (as seen in the direction of arrow B) is engaged by a first mobile holder 19. This holder is coupled to a lever 21 by a linkage (not shown) and a second lever 20. The purpose of the levers 20, 21 and of the linkage is to ensure that the holder 19 can move with the adjacent pack 12 in the direction of the arrow B while the pusher 18 performs a forward stroke. The lever 20 causes the holder 19 to move vertically and out of the path of the pack 12 when the pusher 18 completes its forward stroke. On the other hand, the lever 21 guides the holder 19 for movement along the path for successive packs 12 in the direction of the arrow B.

Figure 5:
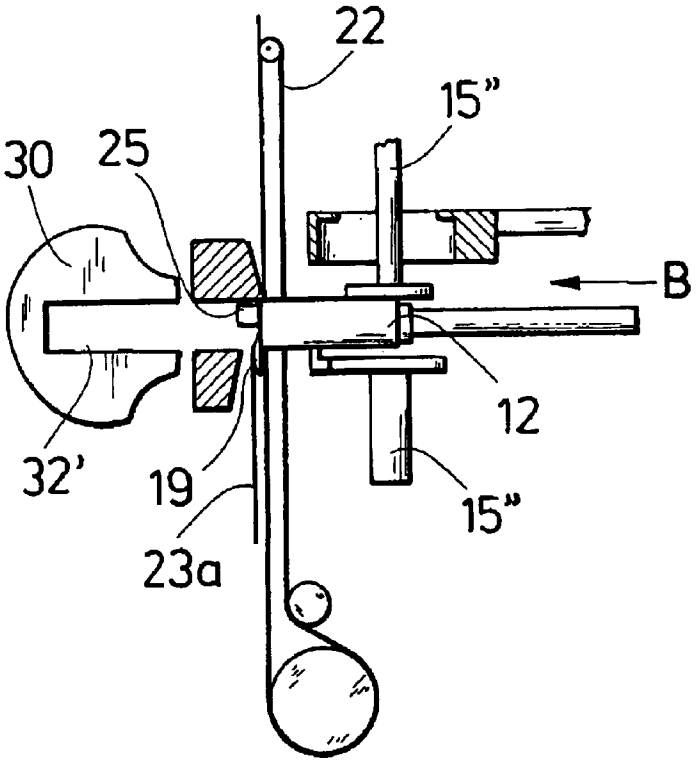
FIG. 5 shows the structure of FIGS. 3 and 4 but with a pack in a different position relative to the foremost blank in which the foremost blank is caused to engage a second holder of the urging means.
Figure 7:
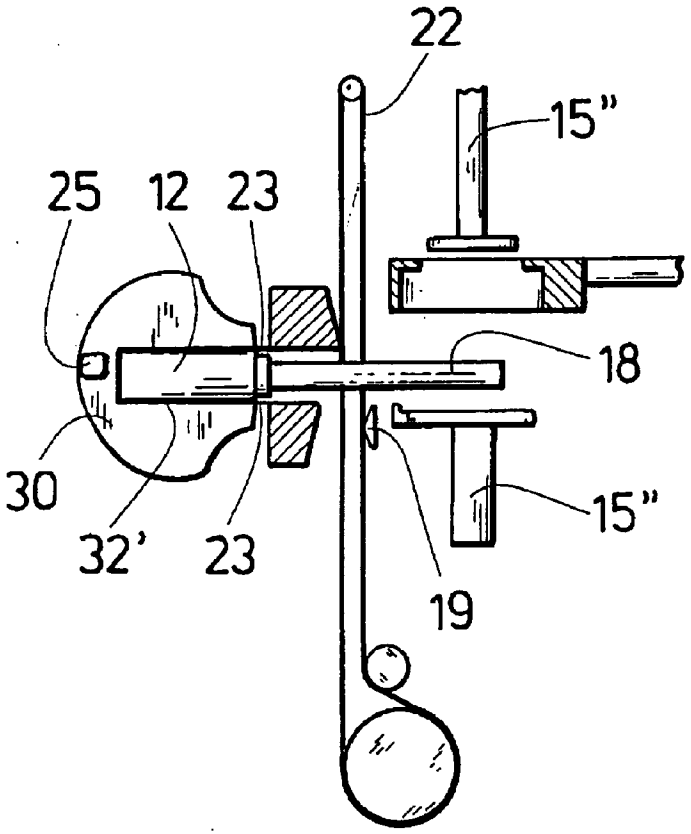
FIG. 7 illustrates the structure shown in FIGS. 3 to 6 but with a pack and the respective blank in a pocket of the first turret.
Figure 6:
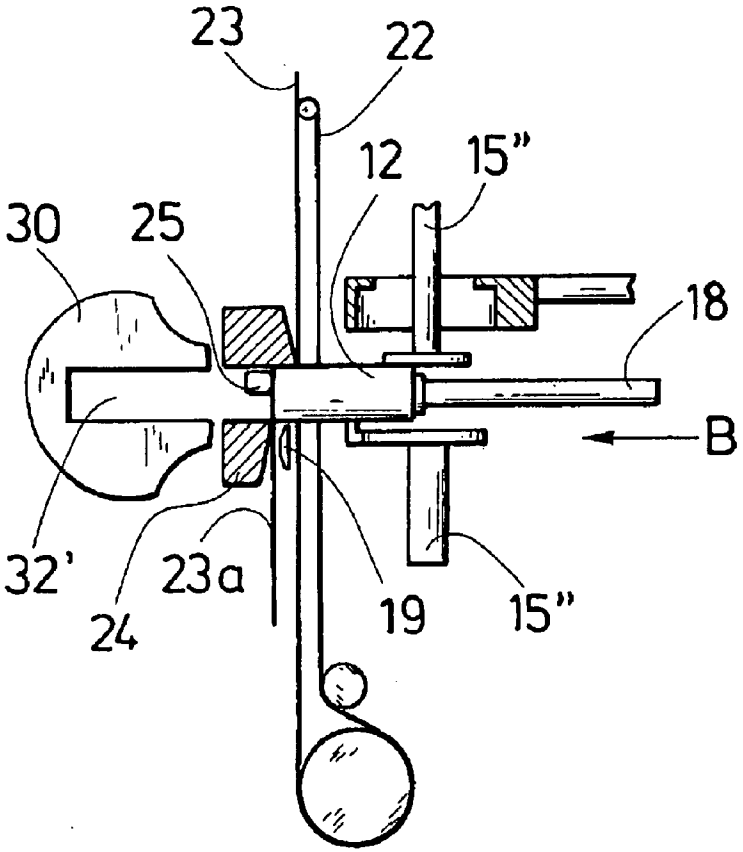
FIG. 6 shows the structure of FIGS. 3 to 5 but with a finished pack in a further position relative to a first turret of the mechanism for carrying out the draping of blanks about the envelopes of the respective finished packs.

The apparatus further comprises means for advancing a continuous web 23 of coherent blanks 23*a* (FIGS. 5 to 7)

along a vertical or substantially vertical path A in a direction from a source (such as a bobbin or reel, not shown) downwardly to a station E where the foremost blank 23*a* is engaged and entrained by the pack 12 which is advanced by the pusher 18. The web advancing means comprises at least one suction conveyor 22. The exact manner in which the web 23 is transported and subdivided into a succession of discrete blanks 23*a* is or can be identical with or analogous to that described in commonly owned U.S. Pat. No. 6,023,911 granted Feb. 15, 2000 to Elvers et al. for "APPARATUS FOR TRANSPORTING WEBS OF WRAPPING MATERIAL".

The pusher 18 of the means for conveying successive packs 12 along their path in the direction of arrow B is movable back and forth in and counter to the direction indicated by this arrow and causes successive packs 12 to entrain successive foremost (lowermost) blanks 23*a* in the direction of the arrow B toward and into a stationary mouthpiece 24 which drapes portions of the blanks 23*a* about the respective packs 12. The forward stroke of the pusher 18 is terminated when the pack 12 in front of it enters a radial pocket 32' of an indexible turret 30 which is arranged to turn about a horizontal axis. This results in conversion of the respective blank 23*a* into a U-shaped body which overlies the front panel and the two major lateral panels of the inner envelope forming part of such pack.

The turret 30 cooperates with various folding, adhesive applying, pressing and other instrumentalities, not shown, preferably in a manner as disclosed in the aforementioned U.S. Pat. No. 4,999,967 to Hoffmann, to shape successive blanks 23*a*, i.e., to bring their configuration nearer to those of acceptable outer envelopes.

The apparatus further comprises a second holder 25 and a third holder 26. These holders serve as additional components of the means for mechanically urging against each other at least those portions (such as 34) of the packs 12 at the station B and at locations or path sections downstream of this station which contact partially hardened or set adhesive layers. The holder 25 is set up to press one or more selected portions of the inner envelopes of successive packs 12 against the adjacent portions of the mouthpiece 24 at the station E.

The holder 25 is located immediately or closely downstream of the intermittently descending web 23 and is movable by a lever 27 which can move this holder horizontally in the direction indicated by the arrow B while the holder 25 engages at least one portion (34) of an inner envelope then advancing within the mouthpiece 24. The holder 26 is designed to move in front of a pack 12 as soon as or even before such pack is released by the pusher 18. This holder 26 serves to engage one of the outer flaps 34. When the pusher 18 is retracted, the third holder 26 engages the lower part of the rear end of the partially converted blank 23*a* and folds it against the pack.

The holder 25 is preferably mounted and displaceable in such a way that it is movable back and forth along an at least substantially horizontal path.

The turret 30 is followed by a second turret 31 which is also indexible about a horizontal axis and has open pockets 32" for reception of packs 12 and partly converted blanks 23*a* from the turret 30. Furthermore, the turret 30 cooperates with a stationary upper folder 28 which serves to fold the upper part of a partly converted blank 23*a*. In addition, the upper folder 28 can serve as a means for folding one of the lateral flaps of the outer envelope (converted blank 23*a*).

The upper folder 28 is followed by a sealing device 29 for the converted blanks 23*a*, i.e., for the outer envelopes of successive packs 12. This not only completes the conversion of blanks 23*a* into outer envelopes but also ensures that the inner envelopes including the flaps 34 cannot change their shapes, i.e., the inner envelopes are compelled to retain their desired configurations with attendant complete setting of the adhesive which was applied by the paster means 13 and which was applied to selected constituents of the inner envelopes.

The turret 30 indexes successive packs 12 and the corresponding outer envelopes (converted flanks) 23*a* through 180° and thereupon introduces each such pack and its outer envelope into the radially extending open pocket 32" of the turret 31. The turret 31 can transport successive packs 12 and their outer envelopes past one or more instrumentalities (not shown) each of which can perform one or more tasks in connection with the conversion of packs 12 and blanks 23*a* into finished packs each having an inner envelope and an outer envelope. For example, the instrumentalities cooperating with the second turret 31 can serve to fold portions of the blanks at the upper sides and/or at the undersides of the outer envelopes (converted blanks 23*a*).

Figure 3:
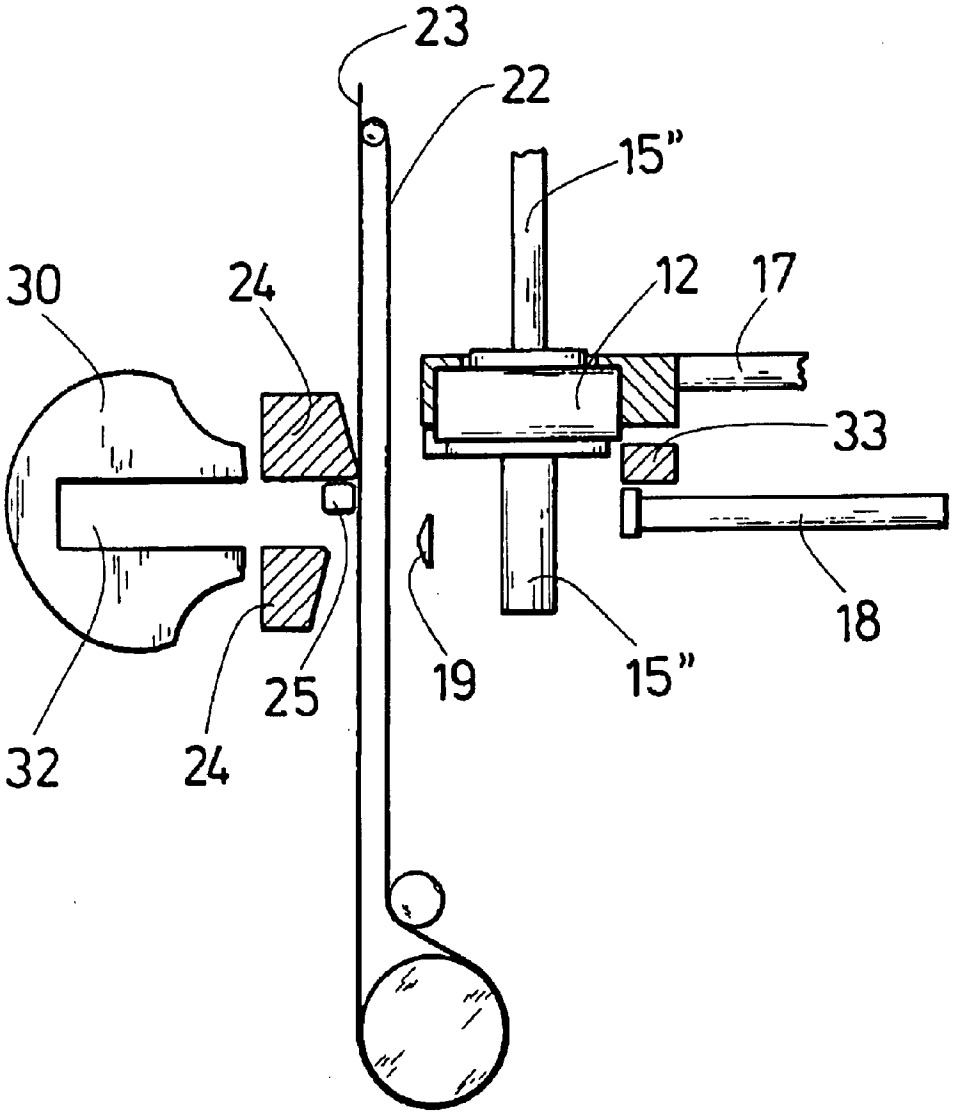
FIG. 3 is an enlarged view of a detail in the apparatus of FIG. 1, a finished pack being shown prior to positioning in front of a pusher of the means for conveying successive packs of a series of packs toward and beyond the station where the packs entrain successive foremost blanks of a succession of blanks which are convertible into outer envelopes of the ultimate products.

FIGS. 3 to 7 illustrate various stages of conversion of the web 23 into blanks 23*a* and of conversion of blanks 23*a* into the outer envelopes of successive packs 12. Referring first to FIG. 3, a pack 12 is shown prior to lowering by the elevator 15" from the turntable 17 to a level in front of the pusher 18 which is shown in the retracted position. The first holder 19 and the second holder 25 are shown in their starting positions; furthermore, only the pack-engaging portions of these holders are actually shown in FIG. 3. Still further, FIG. 3 shows a stationary additional folder 33 which serves to prevent opening of the right-hand lateral flaps of the inner envelope forming part of the pack 12 in a pocket of the turntable 17. A similar stationary holder (not shown) is or can be provided at the left-hand side of the pack 12 which is shown in FIG. 3.

Figure 4:
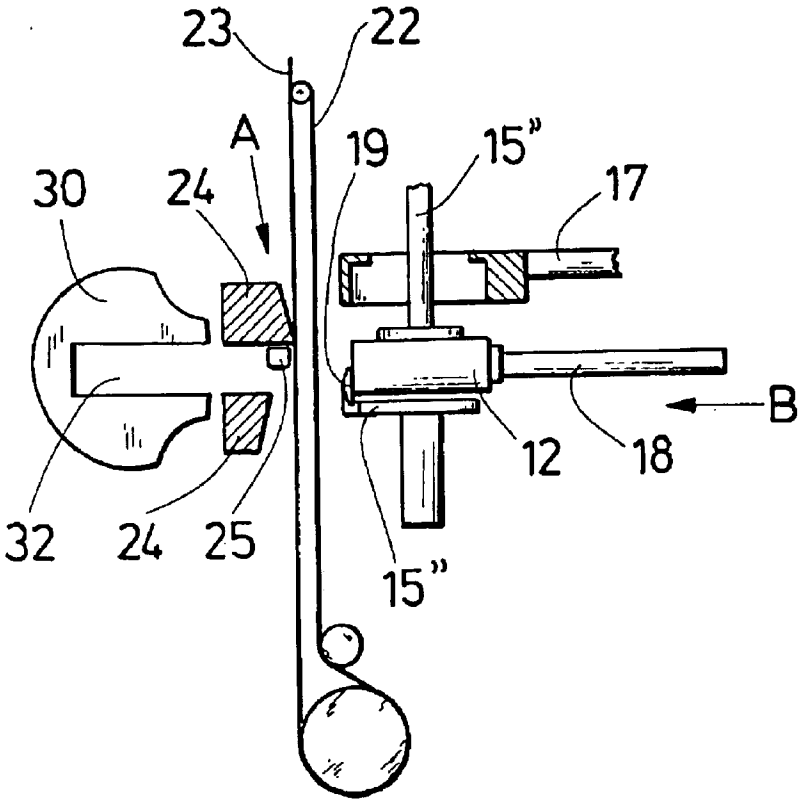
FIG. 4 shows the structure of FIG. 3 but with the front side of the inner envelope of the pack engaged by a first holder of the means for mechanically urging portions of inner envelopes of the finished packs against each other.

FIG. 4 shows a pack 12 in front of the pusher 18. The transfer of a pack 12 from the level shown in FIG. 3 (i.e., in or on the turntable 17) to the level shown in FIG. 4 is accomplished by resorting to the elevator 15" which can comprise an upper piston or plunger and a lower piston or plunger movable up and down in synchronism with the upper piston.

FIG. 5 illustrates the pusher 18 in a partly extended position (i.e., to the left of the position shown in FIG. 4) in which the pack 12 being advanced by the pusher already engages the blank 23*a* located to the right of the mouthpiece 24. At such time, the holders 19 and 25 are operative, i.e, they engage the adjacent portions of the inner envelope and prevent the adhesive-coated portions of the inner envelope from opening up. Those portions of the inner envelope which are located at the trailing end of the pack 12 are held against movement away from each other by the foremost part of the reciprocable pusher 18.

FIG. 6 shows the blank 23*a* of FIG. 5 during a further stage of conversion into the outer envelope of the respective pack 12. The first holder 19 has been moved (pivoted) away from the path of the pack 12 (namely downwardly from the position shown in FIG. 5) and the later is on its way through the mouthpiece 24 and into the registering pocket 32' of the turret 30.

FIG. 7 shows the entire pack 12 of FIG. 6 in the pocket 32' of the turret 30. The second holder 25 has been moved to a position out of contact with the pack 12 in the pocket 32', i.e., the position of such pack is determined solely by the surfaces bounding the pocket 32". The next step involves engagement of the partially converted blank 23*a* with a non-illustrated folding member which pivots a portion of the partly converted blank 23*a* upwardly against the exposed outer side of the inner envelope of the pack 12. The pusher 18 is thereupon withdrawn and the turret 30 is indexed to advance the pack 12 toward the turret 31.

An important advantage of the improved method and apparatus is that the inner envelope (i.e., a part of a pack 12) is prevented from opening up even if such envelope contains layers or films of an adhesive (such as a cold setting adhesive) which does not or cannot set while the respective pack 12 advances from that part of the packing machine which makes the packs 12 to the turret 30 or 32. Thus, it is now possible to employ a single type of adhesive which need not harden or set prior to the application of a blank 23*a* to be converted into the outer envelope of the ultimate product, namely of a container including a pack 12 and an outer envelope (e.g., a converted light-transmitting blank which surrounds the inner envelope). Such mode of making packs having inner and outer envelopes renders it possible to achieve substantial savings in space (due to shortening of the path for advancement of the packs 12 from the machine or machine part serving to make the packs 12) which is required for the apparatus that applies outer envelopes as well as because a single adhesive is necessary to bond the overlapping parts (including 14) of the inner envelopes to each other. The feature that a single adhesive is necessary renders it possible to achieve savings in the initial and maintenance costs because the packing machine must employ a single set of adhesive storing and adhesive applying devices.

The holders 19 and 25 prevent an opening of inner envelopes while the respective packs 12 are being conveyed from the maker(s) of such packs into the pockets of the turret 30, and the holder 26 can assist in a predictable advancement of the partly finished ultimate products (each of which includes a pack 12 and a converted blank 23*a*) from the turret 30 to the turret 31. Once the conversion of a blank 23*a* into the outer envelope of a pack having inner and outer envelopes is completed, the outer envelope (i.e., the converted blank 23*a* which has been sealed at 29) holds the inner envelope including the flaps 34, 34*a* against expansion, i.e., against separation of those parts of the inner envelope which are supposed to be held against separation from each other by layers or films of adhesive between them.

The provision of holders 19, 25, 26 and/or other suitable means for mechanically urging against each other at least those portions of the inner envelopes of the packs 12 at the station E which are provided with films of glue renders it possible to reduce the number of turrets and/or to operate with a single set of adhesive applicators. Thus, one can dispense with that adhesive applicator or with those adhesive applicators which serves or serve to apply films of hot melt in certain conventional cigarette packing machines.

A further important advantage of the improved method and apparatus is that the making of packs having inner and outer envelopes takes up short intervals of time. This is attributable to the fact that the conversion of blanks 23*a* into outer envelopes can begin prior to complete setting of adhesive films between the overlapping parts of the inner envelopes. Thus, the adhesive which is applied at 13 need not set at the time the respective pack 12 is conveyed into the path of movement of the pusher 18, i.e., such setting can continue during and subsequent to entrainment of a blank 23*a* into the mouthpiece 24 and thence into a pocket 32' of the turret 30 and even into a pocket 32" of the turret 31. In fact, setting of the adhesive layers between the overlapping parts of the inner envelopes can continue while the respective ultimate products (12+23*a*) advance beyond the turret 31, e.g., into a machine known as B 90 pack boxer which is distributed by the assignee of the present application and serves to confine sets of, for example, ten finished packs in so-called cartons. The machine which turns out packs 12 and supplies such packs to the belts 10 shown in FIGS. 1 and 2 can be of the type known as COMPAS 500 packer which is distributed by the assignee of the present application.

An advantage of the utilization of at least two holders (such as 19 and 25) or of at least two sets of holders is that one can ensure predictable advancement of packs 12 toward, through and beyond the station E where such packs engage and entrain successive foremost blanks 23*a*. The second holder(s) 25 preferably engages or engage a given side of the inner envelope of the pack 12 at the station E. As already mentioned hereinbefore, the engagement between the inner envelope of an advancing pack 12 and the second holder 25 can begin as soon as the engagement between such inner envelope and the upstream holder 19 is terminated. The second holder 25 can be disengaged from the adjacent pack 12 as soon as the latter is received in a pocket 32' of the turret 30 because, from then on, the overlapping parts of the inner envelope are prevented from becoming separated from each other by the surfaces bounding the respective pocket 32' of the turret 30 and/or by the respective partly converted blank 23*a*. The third holder 26 can serve to reliably hold the packs 12 in the pockets 32' of the turret 30. This third holder can bear upon a portion of the inner envelope of the pack 12 in a pocket 32' of the turret 30 other than the portion or portions previously engaged by the holder 19 and/or 25. For example, the holder 19 and/or 25 can engage an outer flap 34 at one side of the adjacent pack 12, and the holder 26 can engage an outer flap 34 at the opposite side of such pack. The engagement between the holder 26 and an outer flap of the outer envelope of the adjacent pack 12 can begin or continue upon disengagement of the pusher 18 from such pack.

In the illustrated embodiment of the improved apparatus, the holder(s) 19 and/or 25 bears or bear upon the adjacent portion or portions of an inner envelope while the respective pack 12 is being advanced by the pusher 18. The arrangement is or can be such that the holder 19 or the holders 19, 25 engages or engage the adjacent inner envelope at two opposite sides (e.g., the two outer flaps 34) while the pusher 18 bears upon the rear side or panel of the inner envelope. The pusher 18 is or can be disengaged from the inner envelope of a pack 12 upon engagement of such pack by the third holder 26. Such construction and mode of operation contribute to rapid completion of the outer envelope and to a reduction of the number of parts in the packing machine. As already mentioned hereinbefore, the third holder 26 can also serve as a means for folding selected portions of successive blanks 23*a*, preferably as a means for folding the blanks from below. For example, a standard folding member in a presently known cigarette packing machine can be set up to perform such folding action as well as to serve as a holder (such as the third holder) of the improved apparatus.

An advantage of the sealing device 29 for successive converted blanks 23*a* is that, once a converted blank has been sealed, the respective inner envelope need not be engaged by one or more holders, pushers or the like because, at such time, the finished outer envelope (converted and sealed blank 23*a*) takes over the function of preventing opening of the inner envelope. This renders it possible to employ fewer and simpler holders.

The manner of draping a blank 23*a* around the inner envelope of a pack 12 is or can be such that the initial step involves draping the blank around four of the six sides of the inner envelope. For example, the blank can be draped about the front and rear sides and the two lateral sides of the inner envelope. The sealing device 29 can include or can be provided in addition to a folding member which folds a portion of the blank 23*a* from above at or downstream of the station E. The engagement between the third holder 26 and the inner envelope of an adjacent pack 12 can be terminated when such inner envelope reaches the aforementioned folding member or the sealing device 29.

In a presently preferred embodiment of the improved apparatus, a pack 12 advancing along the path indicated by the arrow B is simultaneously engaged by at least two of the illustrated holders 19, 25 and 26.

It is clear that the improved apparatus further comprises one or more suitable prime movers (electric motors, fluid-operated cylinder and piston units and/or the like) and means for synchronizing the movements of various mobile components including the conveyors 10, 14, 16 17, pusher 18, one or more holders, turrets 30, 31 and others. The exact construction of such synchronizing means forms no part of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of wrapping packs of smokers' products and, therefore, such adaptations should and are intended to be comprehended within the meaning and range of equivalence of the appended claims.

What is claimed is:

1. Apparatus for draping blanks of wrapping material around successive finished packs containing smokers' products and having portions abutting each other and bearing layers of adhesive serving to bond the portions to each other upon setting thereof, comprising:

means for advancing a series of successive blanks along a first path;

means for conveying successive finished packs in a predetermined direction along a second path crossing said first path at a station at which each successive pack engages and entrains a foremost blank of a series of blanks in said first path prior to complete setting of each adhesive layer; and means for mechanically urging against each other at least those portions of the packs at said station which contact partially set adhesive layers, wherein said means for urging and said means for conveying collectively include at least one holder for engaging one side of the packs and at least one pusher for engaging at least another side of the packs prior to engagement with the foremost blank, said at least one pusher and said at least one holder each engaging portions of the packs that contact partially set adhesive layers and moving with each pack to prevent said portions from disengaging from respective abutting portions prior to engagement with the foremost blank.

2. The apparatus of claim 1, wherein said at least one holder is adjacent one side of said second path and located at said station.

3. The apparatus of claim 1, wherein said means for urging includes means for engaging a plurality of portions of each pack being conveyed along said second path against the respective foremost blank in said first path.

4. The apparatus of claim 1, wherein said means for urging comprises a plurality of holders, at least two of said holders being arranged to simultaneously engage a different pack in said second path.

5. The apparatus of claim 1, wherein said means for urging comprises a plurality of discrete holders adjacent said second path and disposed successively along said predetermined direction.

6. The apparatus of claim 5, wherein said plurality of discrete holders include a first holder arranged to temporarily engage successive packs advancing along a first section of said second path, and a second holder arranged to engage successive packs advancing along a second section of said second path downstream of said first section, as seen in said predetermined direction.

7. The apparatus of claim 6, wherein said means for conveying is arranged to partially drape successive foremost blanks of the series around the respective oncoming packs as a result of the conveying of packs along said second path across said first path and beyond said station, as seen in said direction, and further comprising means for completing the draping of blanks around the respective packs in said second path downstream of said station, as seen in said predetermined direction.

8. The apparatus of claim 7, wherein said means for completing the draping of blanks includes a conveyor arranged to receive discrete packs with blanks partially draped therearound, said conveyor being disposed at a third section of said second path downstream of said second section, as seen in said predetermined direction.

9. The apparatus of claim 8, wherein said conveyor is indexible about a fixed axis and has pockets arranged to receive packs and partially draped blanks from said second section of said second path.

10. The apparatus of claim 7, wherein said means for completing the draping of blanks includes means for sealing the blanks.

11. The apparatus of claim 1, wherein said means for urging is arranged to engage portions of packs at least while such packs are being conveyed by said conveying means.

12. The apparatus of claim 1, wherein said means for urging engages portions of packs on at least two different sides.

* * * * *